US008621706B2

(12) United States Patent
Salmon

(10) Patent No.: US 8,621,706 B2
(45) Date of Patent: Jan. 7, 2014

(54) DEVICE FOR WRINGING LIQUID-ABSORBING WIPING ELEMENTS AS WELL AS MOP WRINGER

(75) Inventor: Dirk Salmon, Gilching (DE)

(73) Assignee: VERMOP Salmon GmbH, Gilching (DE)

( * ) Notice: Subject to any disclaimer, the term of this patent is extended or adjusted under 35 U.S.C. 154(b) by 402 days.

(21) Appl. No.: 13/032,831

(22) Filed: Feb. 23, 2011

(65) Prior Publication Data

US 2011/0203071 A1 Aug. 25, 2011

(30) Foreign Application Priority Data

Feb. 24, 2010 (EP) ..... 10154495

(51) Int. Cl.
*A47L 13/59* (2006.01)

(52) U.S. Cl.
USPC ..... 15/261

(58) Field of Classification Search
USPC ..... 15/261
See application file for complete search history.

(56) References Cited

U.S. PATENT DOCUMENTS

| | | | | |
|---|---|---|---|---|
| 1,486,285 | A | 3/1924 | Eiffe | |
| 6,941,612 | B1 * | 9/2005 | Hirse | 15/261 |

FOREIGN PATENT DOCUMENTS

| | | | |
|---|---|---|---|
| CH | 173 044 | A | 2/1935 |
| DE | 9416565 | U1 | 1/1995 |
| EP | 1 138 246 | B1 | 10/2001 |
| FR | 461389 | | 12/1913 |

* cited by examiner

*Primary Examiner* — Randall Chin
(74) *Attorney, Agent, or Firm* — Wolf, Greenfield & Sacks, P.C.

(57) ABSTRACT

A device for wringing liquid-absorbing wiping elements comprises a first substantially plate-shaped pressing jaw (18) and a second substantially plate-shaped pressing jaw (20) that are connected to each other at their respective first ends through a joint (40); and a pressing lever (32) connected, via a first bearing (42) in an articulated manner, to the second pressing jaw (20) at the second end of the second pressing jaw (20). The device is characterized in that the first pressing jaw (18) is arranged stationary with respect to the wringing device (10), and the pressing lever (32) comprises a knee lever portion (48) between the first bearing (42) and a second bearing (50) stationary arranged at the pressing lever (32), wherein at the second bearing (50) a knee lever member (52) is arranged that forms a rigid connection between the second bearing (50) and a third bearing (54) at the second end of the first pressing jaw (18).

15 Claims, 6 Drawing Sheets

DEVICE FOR WRINGING LIQUID-ABSORBING WIPING ELEMENTS AS WELL AS MOP WRINGER

FIELD OF THE INVENTION

The invention concerns a device for wringing liquid-absorbing wiping elements. Further, the invention concerns a mop wringer comprising such a device.

For wet or dry wiping of floor surfaces, mop holders are used, onto which a mop cover (mop head) is fixed. The mop cover needs to be washed regularly and wrung also before the first use so as not to contain excessive liquid. In order to at least partially wring the liquid contained in the mop cover before starting or continuing to clean a floor surface, a device for wringing is employed.

Such a device for wringing liquid-absorbing wiping elements serves to receive a mop cover inserted therein, which is either separately provided or fixed to a holder, and to apply force to it in order to wring the liquid. A device for wringing liquid may be placed onto and integrated into a bucket or a similar collection container. The container serves the purpose of receiving wrung liquid, on the one hand, and may also contain cleaning liquid, on the other hand, into which the mop cover is dipped before wringing.

PRIOR ART

In the state of the art there are known wringing devices for mop covers in a condition fixed to a holder. In particular, such devices are employed for substantially rectangular mop holders and covers.

A device having two pressing jaws between which the mop cover fixed to the mop holder is wrung, is known from document DE 94 165 65 U1. The device described therein comprises two pressing jaws respectively supported by four pins in grooves provided for that purpose on the bucket. In order to move the pressing jaws from an open into a closed position wringing the mop holder, support arms are respectively provided on the pressing jaws perpendicular to the direction of motion of the mop holder, onto which arms the mop holder presses when inserted in order to initiate the movement of the pressing jaws downward and toward each other. In this device, the cleaning personnel have to generate the entire squeezing force by mechanically pressing onto the support members.

In order to reduce the amount of force necessary for wringing the mop holder having a mop cover fixed to the mop holder, document EP 1 138 246 B1 uses a pressing lever connected in an articulating manner to a clamping means and transmitting a force onto the pressing jaws by means of lever action when the clamping means is closed and wringing the pressing jaws into a closed position. The motion sequence for operating the mop wringer is, however, complicated. First, the mop holder with the mop cover fixed thereto is led vertically downward so as to have the first and second pressing jaws laterally enclose it. Once the mop holder having the mop cover has been inserted deep enough, the pressing lever is first rotated in a first direction, thereby bringing a clamping lever attached to the pressing lever into engagement with detents provided on one of the two pressing jaws. Subsequently, the lever is retracted while the clamping lever remains engaged with the detents, and due to the articulated mounting of the pressing lever to the other pressing jaw the pressing jaws are tensioned towards each other, thereby dewatering the mop holder with the fixed mop cover and arranged between the pressing jaws. In order to open the wringing device, the pressing lever has first to be moved backward by a sufficient amount against the rotary motion when pressing, until the clamping lever no longer engages the detents, and subsequently has to be swivelled back in the opposite direction until the wringing device is in its open position and the mop holder with the fixed mop cover can be taken out of the wringing device again.

Document CH 173 044 A describes a wringer for wringing liquid placeable onto a container and having a fixed pressing wall and a movable pressing wall connected thereto in an articulated manner. The wringer is operated by a hand lever which, when pressed downward, reduces the distance between the fixed pressing wall and the movable pressing wall. The actuating mechanism via a knee lever is configured so as to increase the transmission ratio when reducing the pressing space. Document CH 173 044 A is considered to be the closest state of the art.

SUMMARY OF THE INVENTION

It is an object of the invention to provide a compact device for wringing liquid-absorbing wiping elements, which is operable by means of a simple motion sequence and may be held in the closed wringing position with little effort.

This object is achieved by a device for wringing liquid-absorbing wiping elements comprising a first substantially plate-shaped pressing jaw and a second substantially plate-shaped pressing jaw, which are connected at their respective first end by a joint. In the operating position, the respective first end of the pressing jaws is located at the bottom. The device further comprises a pressing lever connected, in an articulated manner via a first bearing, to the second pressing jaw at the second end of the second pressing jaw, i.e. in an upper area of the second pressing jaw when in the operating position. The device is characterized in that the first pressing jaw is arranged stationary with respect to the device and the pressing lever comprises a knee lever portion between the first bearing and a second bearing arranged stationary at the pressing lever, wherein a knee lever member is provided at the second bearing, which forms a rigid connection between the second bearing and a third bearing at the second end of the first pressing jaw. The third bearing is, thus, arranged stationary with respect to the first pressing jaw. Since the first pressing jaw is arranged stationary with respect to the device, also the joint is stationary with respect to the device.

The device according to the invention has a compact structure since the first pressing jaw is not rotated and, thus, may be arranged substantially vertically within the device when in the operating position. In this manner, the device for wringing may be designed in a very compact manner. Further, the inventive pressing lever having the knee lever mechanism shows several advantages. Providing the pressing lever makes it possible to provide it with a sufficiently long lever arm so that the device for wringing can be actuated with little effort. The knee lever mechanism comprising the knee lever portion and the knee lever member provides a fixed connection between the pressing lever attached at the second pressing jaw and the first pressing jaw. Thus, there is no need to first create a connection between the first pressing jaw and the second pressing jaw before the device can be operated. The device may be closed with a single lever motion and opened again by moving the pressing lever in the opposite direction. Despite using a knee lever mechanism, the device has a simple structure since the first portion of the knee lever mechanism, the knee lever portion, forms part of the pressing lever itself and, consequently, in addition to the pressing lever only a single further element, i.e. the knee lever member, needs to be provided which creates the connection between the second bearing at the pressing lever and the third bearing at the first pressing jaw.

According to a preferred embodiment of the invention, the pressing lever is movable between a first opened position having the first and second pressing jaws arranged in a V-shape with respect to each other, and a closed position having the first and second pressing jaws arranged substantially parallel to each other. A V-shaped opening facilitates the introduction of the wiping element to be wrung.

It is particularly preferred if, in the closed position, the knee lever mechanism consisting of knee lever portion and knee lever member is located beyond the dead center. The closed position servers the purpose to dewater a mop holder having a mop cover fixed thereon. To that end it is necessary to hold the device in the closed position for several seconds since the dewatering of the wiping element takes several seconds. Experience shows that cleaning personnel tends to move the pressing lever just into the closed position and to immediately open it again thereafter. If the pressing lever is to be held in a closed position for some time, then in conventional wringing devices this entails sustained effort on part of the cleaning personnel, which may be avoided by the knee lever mechanism according to the invention. If in the closed position the knee lever mechanism is moved beyond the top dead center, the device self-locks in the closed position. No effort is necessary to keep the press in the closed position. After some seconds, the pressing lever can again be opened up to the dead center with little effort and can be smoothly moved further into the completely opened position.

According to a preferred embodiment of the invention, the first bearing extends across the entire width of the second pressing jaw, and at the opposite side of the second pressing jaw with respect to the pressing lever a second knee lever mechanism is fixed to the first bearing in a rotationally rigid manner with respect to the pressing lever, which mechanism comprises two lever members connected to each other in an articulated manner and rotatably fixed to the first pressing jaw. Thus, across the first bearing extending across the entire width of the second pressing jaw, a second knee lever mechanism is provided which is disposed parallel to the first knee lever mechanism at the side of the pressing lever and serves to prevent a non-symmetric application of force and a possible tilting of the device due to an asymmetric application of force.

A further measure to prevent asymmetric application of force consists in providing a U-shaped pressing lever instead of a pressing lever provided only on a side of the device, so that symmetric force conditions exist on both sides with respect to the width of the first and the second pressing jaws.

Preferably, a stopper member is arranged at the pressing lever, which is optionally movable into an active position in which the movement of the pressing lever into the closed position is limited before reaching the dead center of the knee lever mechanism. Depending on the wiping element to be dewatered and depending on the desired degree of dewatering a further closed position can thus be defined. Since this further closed position is located before reaching the dead center of the knee lever mechanism, also the self-locking of the device in the closed position can be switched off.

The pressing jaws preferably comprise a plurality of through openings, preferably slot-shaped passages for the passage of cleaning liquid. In this manner, the wrung liquid does not only flow off downward, where it can exit downward at the joint, but the wrung liquid is directly discharged through the pressing jaws. By providing slot-shaped passages, a relatively large opening surface is generated, while at the same time the slot-shaped passages are kept narrow enough so that the wiping element cannot even partially pass through the through openings.

In order to ensure the desired transmission of force of the pressing jaws onto the wiping element to be wrung, but also to keep torsion of the device as low as possible, the pressing jaws according to a preferred embodiment comprise reinforcement ribs running substantially vertically when in the operating position. The vertical arrangement of the reinforcement ribs serves to not obstruct downward discharge of the cleaning liquid, which may exit to the outside through optional through-openings in the pressing jaws.

In a preferred embodiment of the invention, the first pressing jaw is integrally connected to a side wall having a first guide surface for the pressing lever in particular at the first bearing. The provision of a sidewall has several advantages. On the one hand, it is to be avoided that objects inadvertently reach the region between the first and second pressing jaws from the side and are damaged or damage the device during the wringing process. Further, this side wall has a guide surface or, optionally, also a slotted guide mechanism for the pressing lever at the first bearing, thus exactly guiding the knee lever mechanism.

According to a preferred embodiment, the knee lever mechanism and/or the second knee lever mechanism are configured so that the rotatable members largely overlap with respect to each other. Instead of a narrow connection between the bearing points, a wide, plate-shaped element is provided which overlaps the second rotatable element of the knee lever mechanism independently of the relative position to the respective second rotatable element so that no free space is created between the elements rotatable with respect to each other, into which an object may inadvertently end up, which object might be sheared off under the high lever action of the pressing lever. Therefore, this advantageous embodiment of the elements rotatable with respect to each other serves also to protect the cleaning personnel from injury.

The mop wringer according to the invention comprises a device for wringing liquid-absorbing wiping elements as described above, as well as a collection container onto which the device can be mounted.

Preferably, the pressing jaws extend substantially across the entire width of the collection container. This measure contributes to keep the entire mop wringer as compact as possible.

According to a preferred embodiment of the mop wringer, the collection container comprises a bottom as well as side walls integrally connected to the bottom, and the sidewalls comprise, at the side opposite to the bottom, a reinforced rim on which the device rests through correspondingly shaped supports. Alternatively, it is also possible to design the collection container and the device for wringing to be integral with each other. It is, however, preferred if the device for wringing rests upon a reinforced rim of the collection container and is removable from the latter.

Preferably, the mop wringer further comprises a positive-fit connection between the collection container and the device for wringing, preferably elastic elements in the area of the support portions of the device for wringing, which provide for a snap connection with the reinforced rim. In this manner, the device for wringing may be fixedly connected to the collection container, but can also be quickly and comfortably released again therefrom.

Preferably, the pressing lever is arranged in such a shape that the pressing lever, in the opened position of the device for wringing, does not extend beyond the vertical plane abutting the sidewall of the mop wringer close to the first pressing jaw. This vertical plane defines the end of the mop wringer in the operating position so that the pressing lever does not extend beyond the end of the mop wringer if the pressing lever is in the opened position of the device for wringing. This measure has the purpose to attach the mop wringer to a cleaning trolley for cleaning personnel. Because of the lever action the mop wringer is fixed to a conventional cleaning trolley in such a way that the device for wringing placed onto the collection container is close to the cleaning trolley, while at the side facing away from the cleaning trolley the collection container usually extends also beyond the device for wringing in order to allow a mop holder having a mop cover fixed thereto to dip into the cleaning liquid arranged in the collection container during its use. Both the structure of the device for wringing with the stationary arranged first pressing jaw and the arrangement of the pressing lever together thus serve the purpose of being able to design the mop wringer in an as compact as possible manner and allowing them to be fixed directly to a support frame, for example of a cleaning trolley. To that end, the mop wringer preferably comprises a suitable attachment means for fixing the mop wringer to a cleaning trolley.

BRIEF DESCRIPTION OF DRAWINGS

In the following, the invention is described purely by way of example by referring to the enclosed drawings, in which.

DETAILED DESCRIPTION

Figure 1:
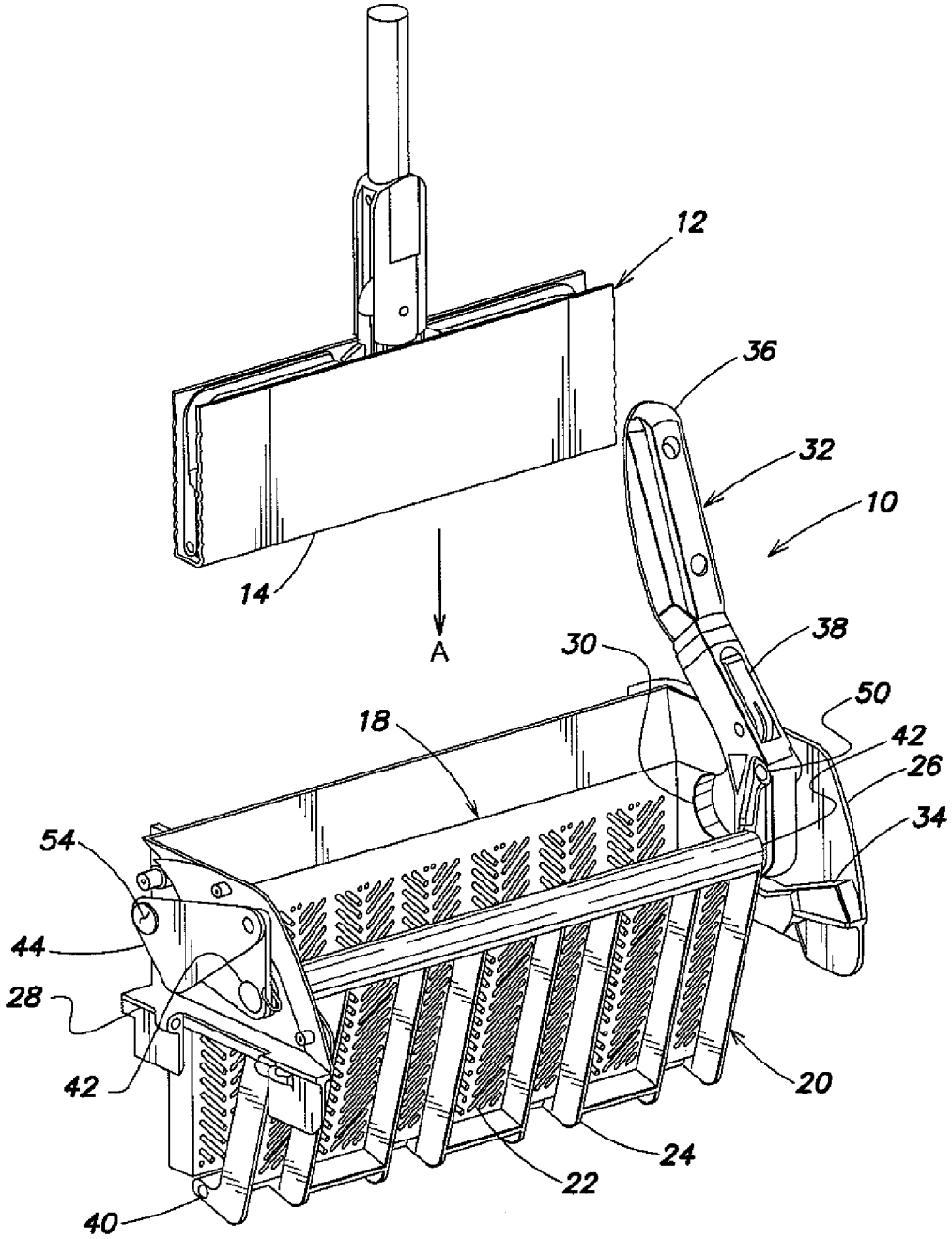
FIG. 1 shows the device for wringing in an opened position, as well as a schematic mop holder with a mop cover fixed thereto.

In the following figures, the same components are indicated with the same reference numerals.

FIG. 1 shows the wringing device generally indicated by the reference numeral 10 and a mop holder 12 having a mop cover 14 fixed thereon in order to illustrate the insertion of the mop holder 12 into the wringing device 10 in the direction of the arrow A. The wringing device 10 is usually placed onto a collection container 16, as will be explained later by reference to FIG. 6*a*.

The wringing device 10 has a first pressing jaw 18 and a second pressing jaw 20, which comprise substantially plate-shaped pressing faces. The pressing jaws 18 and 20 are provided with numerous cut-outs 22 which are, in the present embodiment, slots arranged in a V-shape with respect to each other and occupy a percentage area of over 25% of the pressing faces of the first pressing jaw 18 and the second pressing jaw 20. Additionally, for stabilizing the pressing jaws, reinforcement ribs 24 are provided which, in the mounting position shown in FIG. 1, are arranged substantially vertically so as not to obstruct the discharge of wrung liquid when operating the wringing device 10.

The first pressing jaw 18 is at least partially provided with sidewalls 26 that are integrally connected with the substantially plate-shaped first pressing jaw 18 and extend perpendicularly to the plane of the plate-shape first pressing jaw at their lateral ends. The sidewalls are, on the one hand, provided with a suitable support geometry in the form of support surfaces for placing the wringing device 10 onto a collection container, and additionally comprise a guide surface 30 serving to guide a pressing lever 32 and described in more detail later. Apart from the guide surface 30, the sidewall on the side of the pressing lever 32 is additionally provided with a stopper protrusion 34 limiting the motion of the pressing lever 32 into the closed position of the wringing device shown in FIGS. 4 and 5.

The pressing lever 32 comprises a handle portion 36 and a stopper element 38 which can be pivoted from the sunk-in position in the shaft of the pressing lever 32 into an extended operating position, and in this manner limits the rotary motion of the pressing lever 32 up to contacting the stopper protrusion 34. In other words, the stopper element 38 may be brought into an operative position projecting beyond the outer contour of the pressing lever, in which the pressing lever abuts against the stopper protrusion 34 after a smaller angle of rotation and in which, thus, the pressing jaws 18 and 20 are not brought into the completely closed position.

Figure 2:
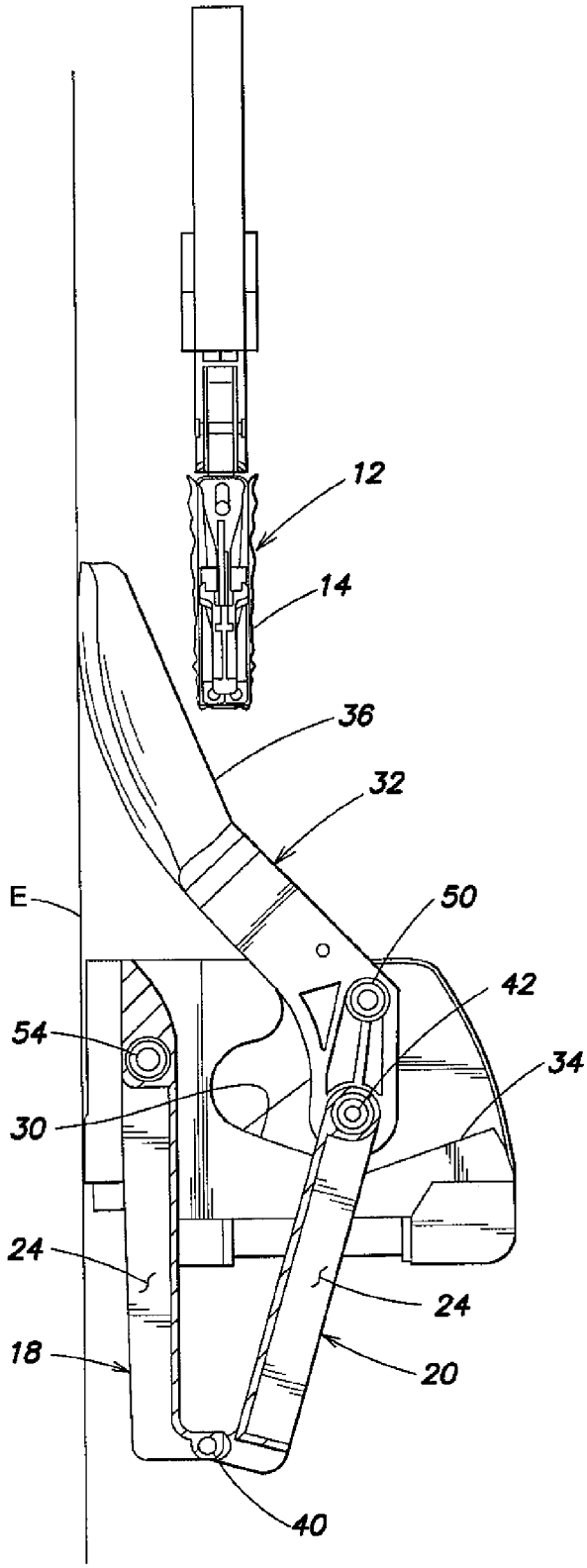
FIG. 2 shows a side view of the device for wringing shown in FIG. 1 as well as of the mop holder with the mop cover fixed thereto.
Figure 3:
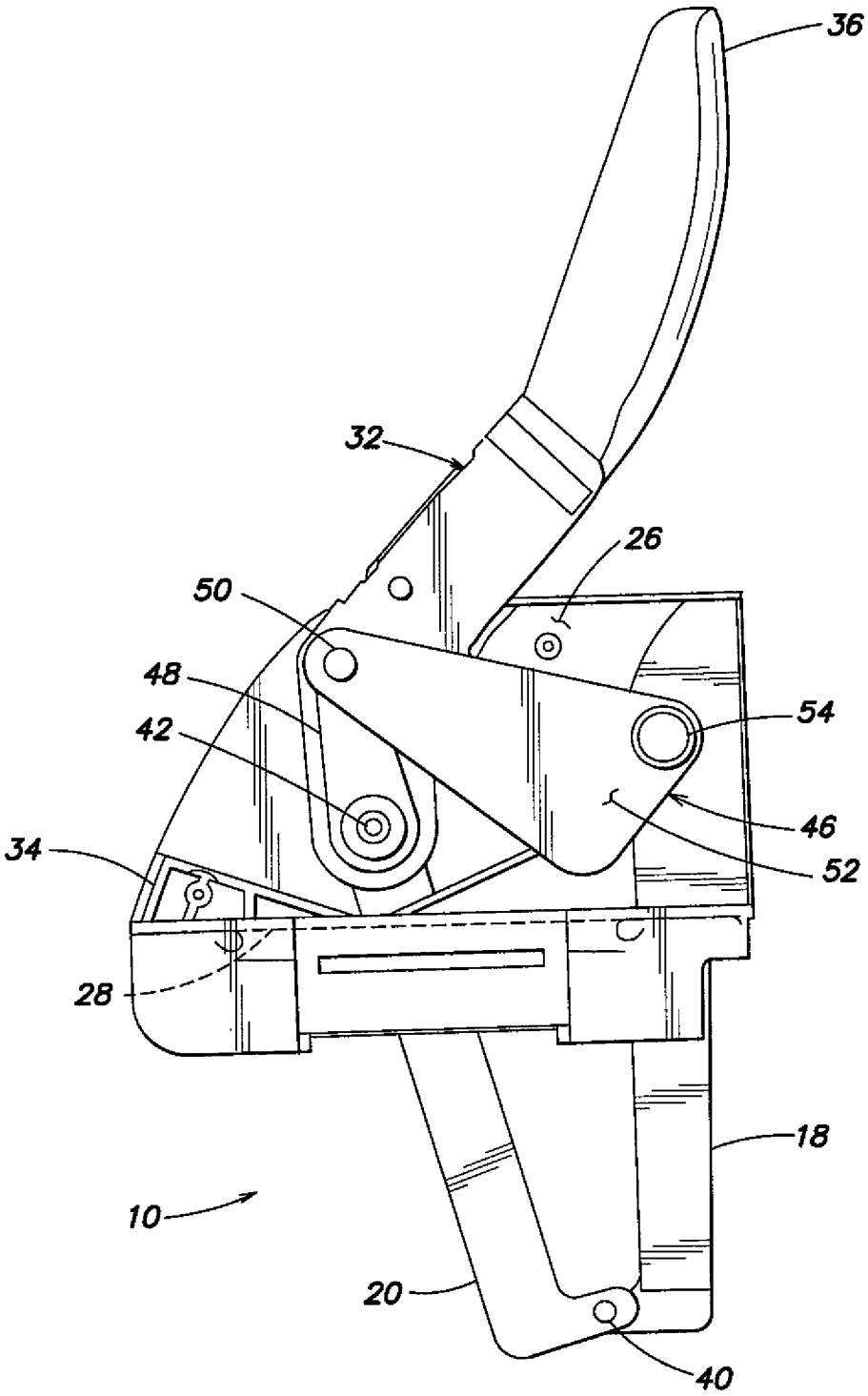
FIG. 3 shows the device for wringing in a side view and in the opened position.
Figure 5:
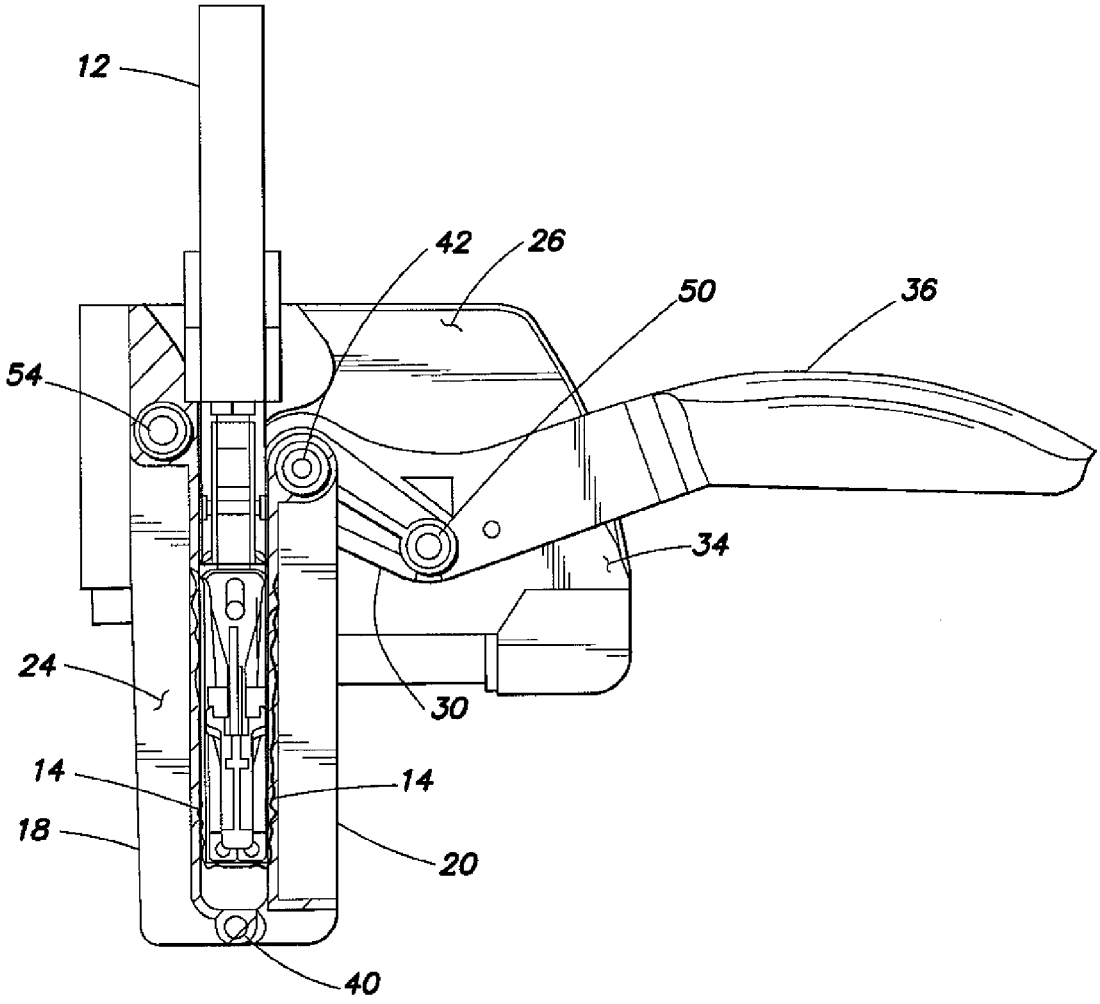
FIG. 5 shows the device for wringing in the closed position and with a mop holder having a mop cover arranged therein.

The first pressing jaw 18 and the second pressing jaw 20 are connected to each other at their respective lower ends via a joint 40 and are rotatable from the V-shape arrangement with respect to each other shown in FIGS. 1 to 3 into the arrangement shown in FIG. 5, in which the first pressing jaw 18 comes to rest substantially parallel to the second pressing jaw 20.

The relative rotation between the first pressing jaw 18 and the second pressing jaw 20 is effected exclusively by a motion of the second pressing jaw 20, since the first pressing jaw 18 is arranged stationary within the wringing device 10. This means that also the joint 40 is arranged stationary within the wringing device 10 and that the closing motion of the wringing device is exclusively effected by rotating the second pressing jaw 20 around the joint 40.

In order to rotate the second pressing jaw 20, a pressing lever 32 is employed, which is rotatable around the first bearing 42 located at the upper edge of the second pressing jaw 20. The knee lever mechanism used is described in more detail by means of the following figures, but from FIG. 1 it can be seen that for reasons of an as much as possible symmetric motion of the second pressing jaw 20 without distortions, a knee lever mechanism 44 connected via a rotationally rigid connection of a first knee lever member with the rotational axis of the pressing lever 32 is provided also at the side of the second pressing jaw remote from the pressing lever 32.

FIG. 2 shows a section through the wringing device from the side remote from the pressing lever and emphasizes that also the first pressing plate 18 is provided with reinforcement ribs 24. Further, a guide surface 30 is shown in FIG. 2, which in the completely opened position of the wring device 10 shown in FIG. 2 does not yet have a function.

From FIG. 2 it can be seen that in the opened position of the wringing device 10 the pressing lever 32 does not extend beyond the plane denoted by reference symbol E, which plane defines the maximum extension of the wringing device 10 without pressing lever, when in the operating position. This has the advantage that the wringing device 10 or the wringing device with a suitably configured collection container may be used in a manner so as to be fixed to a flat component such as a cleaning trolley without impairing the function of the wringing device, because the pressing lever can no longer be moved up to the completely opened position.

FIG. 3 also shows a side view of the wringing device 10 in an opened condition and the first knee lever mechanism 44 used therein.

The knee lever mechanism 44 comprises a knee lever portion 48 which is part of the pressing lever 32 and extends from the first bearing 42 for rotatably fixing the pressing lever 32 at the upper end of the second pressing jaw 20 up to the second bearing 50 arranged at the pressing lever. At the second bearing 50 a knee lever member 52 is arranged rotatably with respect to the pressing lever 32, which knee lever member is fixed via a third bearing 54 in proximity to the upper end of the first pressing jaw 18. The third bearing 54 is thus arranged stationary with respect to the wringing device 10. As is further emphasized in FIG. 3, the knee lever member 52 has a large-area extension in order to keep the free space between the knee lever portion 48 and the knee lever member 52 as small as possible so that during operation of the wringing device 10 no objects can inadvertently end up in the free space between the knee lever portion 48 and the knee lever member 52 and be damaged during the closing motion.

Figure 4:
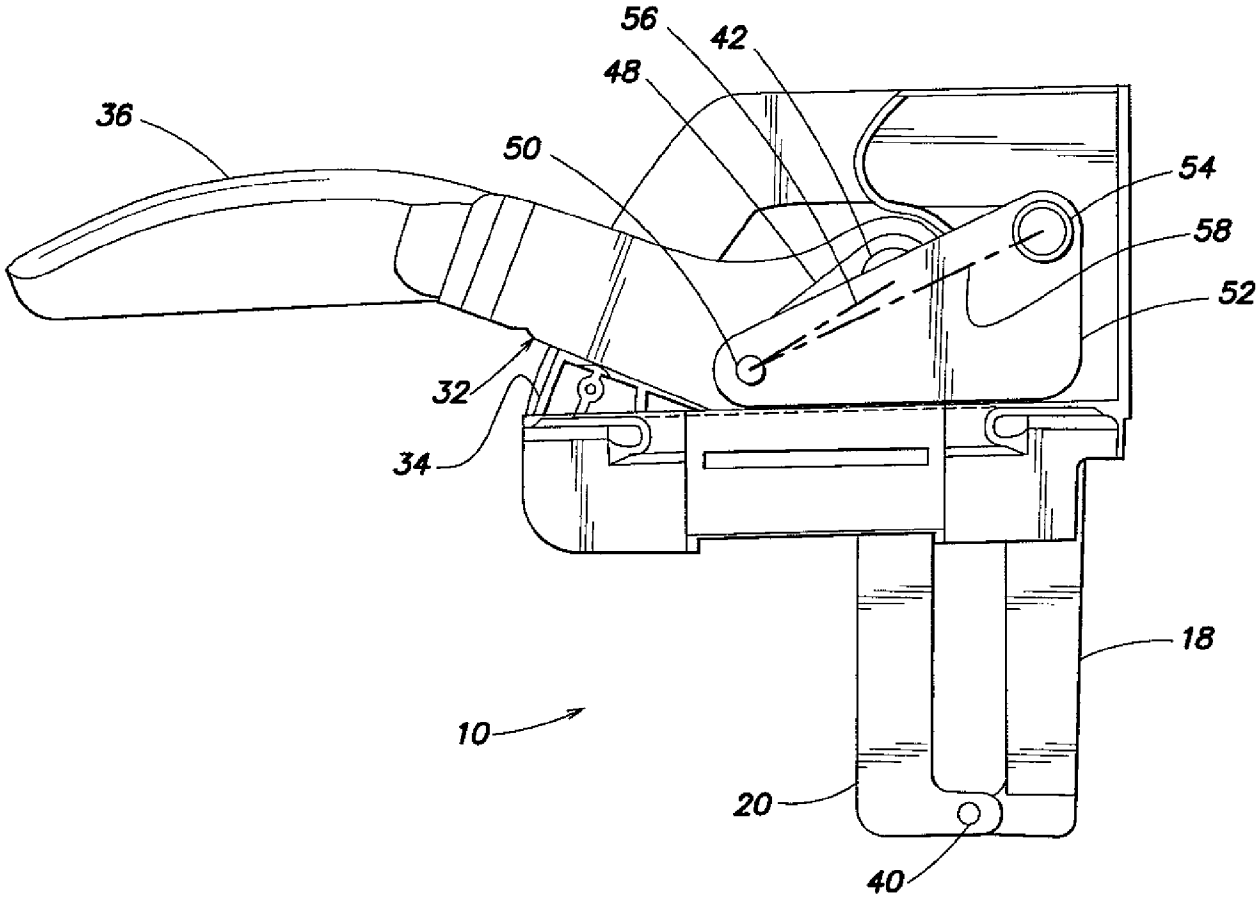
FIG. 4 corresponds to the view of FIG. 3, but with the device for wringing being shown in the closed position.

FIGS. 4 and 5 show the wringing device in the closed position, wherein the view of FIG. 4 corresponds to that of FIG. 3, and the view of FIG. 5 corresponds to that of FIG. 2. In the view of FIG. 4, the pressing lever 32 has been completely rotated into the closed position and into abutment with the stopper projection 34. In this position, the knee lever mechanism 44 consisting of the knee lever portion 48 and the knee lever member 52 has been rotated beyond dead center, as can be seen from the orientation of the first axis 56 of the knee lever portion 48 and of the second axis 58 of the knee lever member 52. In this position, self-locking of the first knee lever mechanism occurs and the wringing device 10 remains, without applying any force onto the pressing lever 32, in the shown closed position in which the second pressing jaw 20 comes to rest substantially parallel to the first pressing jaw 18. To open the wringing device 10, the pressing lever 32 merely has to be raised through a very small angular range by applying force until the dead center is reached, at which the first axis 56 is parallel to the second axis 58. After overcoming the dead center, the wringing device may be completely opened without effort.

In the closed position, also shown in FIG. 5, the pressing lever rests completely on the guide surface 30 and the wiping element 14 fixed to the mop holder 12 is dewatered between the pressing jaws that are substantially arranged in parallel.

Figure 6B:
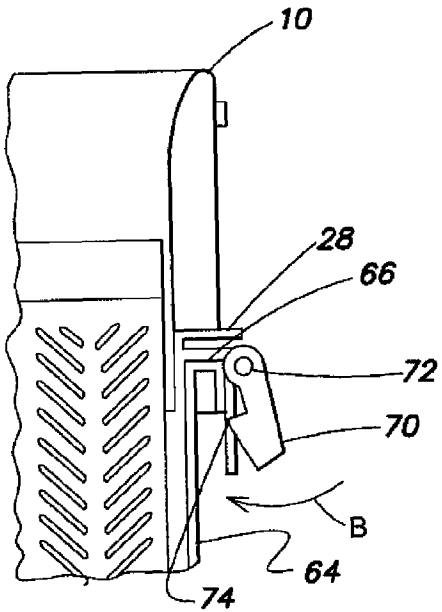
FIG. 6*b* shows the device for wringing being fixed on a collection container.
Figure 6A:
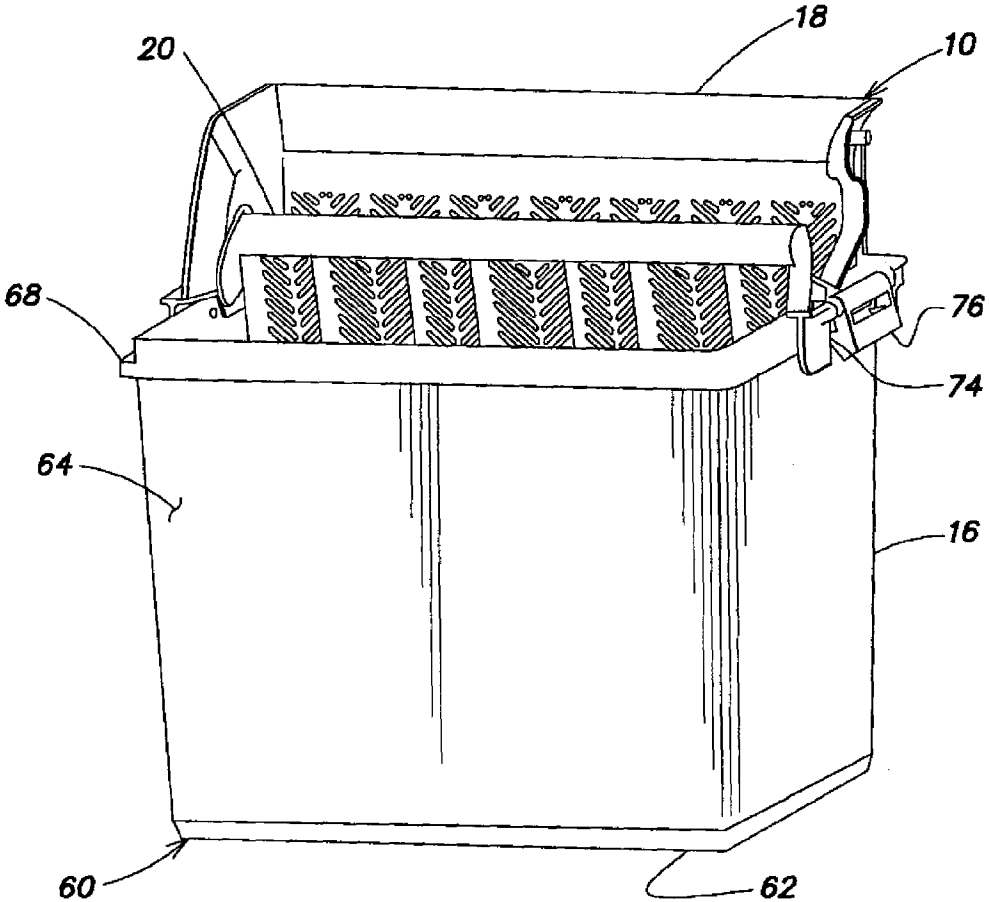
FIG. 6*a* shows the device for wringing placed upon a collection container.

In FIGS. 6*a* and 6*b*, the wringing device 10 mounted onto the collection container 16 is shown. The mop wringer generally indicated by the reference numeral 60 comprises a substantially cuboid-shape collection container 16 which comprises a closed bottom 62 and sidewalls 64 having an upper rim 66 suitable for placing and fixing the wringing device 10. This may be a conventionally flanged rim, but also a step-shaped ledge 68 may be provided, on which the wringing device with its support surfaces 28 is resting (see also FIG. 1).

Additionally, a means of fixation for the wringing device 10 is advantageously provided on the collection container 16. This means of fixation may be realized by a snap connection like the one shown in FIGS. 6*a* and 6*b*. In order to better illustrate the snap connection, the pressing lever and the knee lever mechanism are not shown in FIGS. 6*a* and 6*b* as they would have partially obstructed the view of the snap connection. As is in particular illustrated in the detailed view of FIG. 6*b*, a mounting hook 70 may be provided at both sides of the wringing device 10, which hook is rotatable around a pin 72 and is additionally subjected to torque in the direction of arrow B by a torsion spring so that the barbed hook 74 engages the upper rim 66 of the collection container from below and locks the wringing device 10 onto the collection container 16. The wringing device 10 may, however, be easily removed again from the collection container 16 by grasping the edge 76 from below at both sides and rotating the mounting hook 70 to the outside, that is to the outside against the direction of arrow B and against the bias of the torsion spring, until the wringing device can be vertically lifted off from the collection container.

As can further be seen from FIG. 6*a*, the first pressing jaw 18 and the second pressing jaw 20 preferably extend across the entire width of the collection container, thus making the mop wringer as compact as possible. This is also the purpose of the stationary arranged first pressing jaw 18, which may be arranged substantially parallel to the back wall of the collection container not shown in FIG. 6*a*, thus optimally utilizing the available space. Preferably, the wringing device 10 is placed onto the collection container 16 in such a manner that the end plane E is also the end plane of the collection container arranged below it. In this manner, the mop wringer 16 may be attached at a suitable location such as on a cleaning trolley, wherein for mounting the collection container 16 to the cleaning trolley one may chose any mounting alternative known to the skilled person, such as vertically arranged insertion lugs protruding downward from the upper rim 66, which lugs may be inserted into correspondingly shaped pockets on the cleaning trolley during the vertical insertion motion.

The inventive wringing device and mop wringer have a particularly compact structure and the mop wringer, at its backside, may be mounted flush with a cleaning trolley since the swivel range of the lever is not obstructed by it. The operation of the wringing device is simple since the wringing device may be closed with a single motion and may be opened again with a motion in the opposite rotation direction. Moreover, without applying force the wringing device may be kept in the closed position because a knee lever mechanism is used which, in the closed position, has been moved beyond its dead center. All these measures cooperate in order to provide a wringing device for a mop wringer that is as much as possible user-friendly due to its compactness and ease of use.

The invention claimed is:

1. Device for wringing liquid-absorbing wiping elements, comprising:

a first substantially plate-shaped pressing jaw and a second substantially plate-shaped pressing jaw, which are connected to each other at their respective first ends through a joint; and a pressing lever that is connected in an articulated manner with the second pressing jaw at the second end of the second pressing jaw through a first bearing; wherein the first pressing jaw is arranged stationary with respect to the wringing device; and the pressing lever comprises a knee lever portion between the first bearing and a second bearing stationary arranged at the pressing lever;

wherein a knee lever member is mounted to the second bearing, which member forms a rigid connection between the second bearing and a third bearing at the second end of the first pressing jaw.

2. The device of claim 1, wherein the pressing lever is movable between an opened position having the first and second pressing jaws arranged in a V-shape to each other and a closed position having the first and second pressing jaws arranged substantially parallel to each other.

3. The device of claim 2, wherein in the closed position a knee lever mechanism consisting of the knee lever portion and the knee lever member is located in the position of a top dead center.

4. The device of claim 3, wherein a stopper member is arranged at the pressing lever, which member is optionally movable into an operative position in which the movement of the pressing lever into the closed position is limited before reaching the dead center of the knee lever mechanism.

5. The device of claim 2, wherein the first bearing extends across the entire width of the second pressing jaw, and, at the side of the second pressing jaw opposite to the pressing lever, a second knee lever mechanism is fixed to the first bearing in a rotationally rigid manner with respect to the pressing lever, wherein the second knee lever mechanism comprises two lever members connected to each other in an articulated manner and is rotatably mounted on the first pressing jaw.

6. The device according to claim 3, wherein the knee lever mechanism is configured in such manner that the knee lever portion and the knee lever member rotatable with respect to each other largely overlap.

7. The device according to claim 1, wherein the pressing jaws-comprise a plurality of through openings for the passage of cleaning liquid.

8. The device according to claim 1, wherein the pressing jaws comprise reinforcement ribs that run substantially vertically in the operating position of the device.

9. The device according to claim 1, wherein the first pressing jaw is integrally connected with at least one sidewall, which comprises a guide surface for the pressing lever.

10. Mop wringer, comprising a wringing device according to claim 1 and a collection container onto which the wringing device can be mounted.

11. The mop wringer of claim 10, wherein the pressing jaws extend substantially across the entire width of the collection container.

12. The mop wringer of claim 10, wherein the collection container comprises a bottom and sidewalls integrally connected to the bottom, and the sidewalls comprise, at the opposite side of the bottom, a reinforced upper rim on which the wringing device having correspondingly formed support portions is resting.

13. The mop wringer according to claim 10, further comprising a positive-fit connection between the collection container and the wringing device which elements create a snap connection with a reinforced upper rim of the collection container.

14. The mop wringer according to claim 10, wherein the pressing lever is shaped and arranged so as not to extend, in an opened position of the wringing device, beyond the vertical plane abutting the sidewall of the mop wringer in proximity to the first pressing jaw.

15. The mop wringer according to claim 10, wherein the mop wringer comprises a suitable mounting means for mounting the mop wringer to a cleaning trolley.

* * * * *